US006505411B2

(12) United States Patent
Gooden

(10) Patent No.: US 6,505,411 B2
(45) Date of Patent: Jan. 14, 2003

(54) T-SQUARE SAW GUIDE

(76) Inventor: Richard E. Gooden, 62 Crosby St., Milford, NH (US) 03055

( * ) Notice: Subject to any disclaimer, the term of this patent is extended or adjusted under 35 U.S.C. 154(b) by 74 days.

(21) Appl. No.: 09/772,166

(22) Filed: Jan. 29, 2001

(65) Prior Publication Data

US 2002/0100174 A1 Aug. 1, 2002

(51) Int. Cl.[7] ..... B27B 9/04; B43L 7/00

(52) U.S. Cl. ..... 33/484; 33/443; 33/42; 83/744; 83/745

(58) Field of Search ..... 33/42, 479, 640, 33/429, 430, 443, 474, 613, 626, 628, 630, 484; 83/743, 744, 745

(56) References Cited

U.S. PATENT DOCUMENTS 515,522 A * 2/1894 Frank ..... 33/484
4,281,572 A * 8/1981 Stovall ..... 33/443
4,394,800 A * 7/1983 Griset ..... 33/42
4,463,644 A * 8/1984 Ferdinand et al. ..... 83/745
5,084,977 A * 2/1992 Perkins ..... 83/745
5,459,937 A * 10/1995 Albin et al. ..... 33/42

* cited by examiner

*Primary Examiner*—Christopher W. Fulton
(74) *Attorney, Agent, or Firm*—Davis & Bujold, P.L.L.C.

(57) ABSTRACT

A portable saw guide and T-square and method of use where an accurate and straight saw cut is desirable. The T-square saw guide has an alignment arm and a flexible guide arm which can be quickly and accurately secured to a work piece such as a sheet of plywood by a clamping mechanism in order that a worker may use a guide edge of the T-square to accurately maneuver and guide a saw along a desired course despite variations in the surface of the work piece. The guide arm forms a flush linear contact between a surface of the workpiece and the saw guide to compensate for any non planar irregularities such as a bow, sag or warp in the work piece to cause continuous contact between the saw being guided along the guide edge of the T-square to produce a straight cut along the work piece.

11 Claims, 4 Drawing Sheets

T-SQUARE SAW GUIDE

FIELD OF THE INVENTION

The present invention relates to a portable saw guide and T-square and method of use where an accurate and straight saw cut is desirable when cutting raw construction materials. Specifically the invention is an improved T-Square which can be quickly and accurately secured to a work piece such as a sheet of plywood in order that a worker may use a guide edge of the T-square to accurately maneuver and guide a saw along a desired course. The portable saw guide securely clamps to the work piece and is capable of providing a flush linear contact between a surface of the workpiece and the saw guide to compensate for any non planar irregularities such as a bow, sag or warp in the work piece to facilitate continuous contact between the saw being guided and the guide edge of the T-square to produce a straight cut along the work piece.

BACKGROUND OF THE INVENTION

In the construction industry, raw materials, particularly lumber, specifically plywood and other rough cut wood materials which are used at a job site are rarely perfectly straight, square or planar as the case may be. The standard for cutting such materials at a job site is generally by use of a portable electric circular hand saw as is known in the industry. Access to a more functional table saw at a construction site is usually not available or inefficient in practice. The common practice in the construction industry is to cut lumber on a lumber pile or place lumber on saw horses in order to facilitate the cutting of a work piece with the electric circular saw. The nature of new lumber is to have slight warps or bends and the practice of using saw horses to support the lumber for cutting operations creates substantial difficulty in that the saw horses, which are linear supports, do not provide support along the entire planar surface of the lumber being cut. For instance where a common sheet of 4×8 ft. plywood is supported between a pair of saw horses, the plywood tends to bow or sag on either sides of the saw horses.

It is well known in the industry to snap a chalk line on the lumber and cut the plywood freehand solely using the saw's guide aligned with the chalk line. However, despite care of the user, the vibration of the circular saw together with any bow or sag in the lumber being cut, trying to guide the saw across the wood by following the chalk line leads to an inaccurate cut along the chalk line. This type of rough cut method is not adequate in most framing and construction projects, specifically when sheathing a wall or roof with plywood, any inconsistent cut in an initial or first sheet of plywood leads to a significantly exaggerated and increasing inconsistency as subsequent sheets are applied adjacent to the first.

To compensate for such freehand use a construction worker will use a make shift jig. This is where a material with a straight edge is fastened to the plywood so that the circular saw's fence is guided along the edge of the jig. The problem with this method is that due to its nature and dimensions plywood tends to warp and bow and a gap results between the plywood and the jig. As the saw is guided along the surface of the plywood it reaches the area of the gap created between the jig and the surface being cut and the saw slides into the gap between the jig's straight edge and the plywood precipitating an undesired and inaccurate cut.

SUMMARY OF THE INVENTION

It is the object of the invention to provide a substantially immovable and secure saw guide for use with a circular saw to provide a straight cut of a raw construction material.

It is another object of the invention to provide a self securing device which provides such a guide for a circular saw with a minimum of manual intervention by a user.

It is a further object of the invention to compensate for any irregularities or a bow or sag in the material by providing the T-square saw guide with a flexible saw guide fence in intimate contact with the surface of the material being cut for mutually bowing or sagging with the material to facilitate a straight cut along the bowed or sagging material.

It is a still further object of the invention to provide a portable saw guide device which is inexpensive, light weight and may be quickly clamped and unclamped to a rough material being cut.

Another object of the invention is to provide a portable saw guide device which can retain appropriate lateral saw guiding stability while ensuring a longitudinally transverse flexibility for remaining in intimate contact with the surface being cut and which can withstand the working conditions of a construction site

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
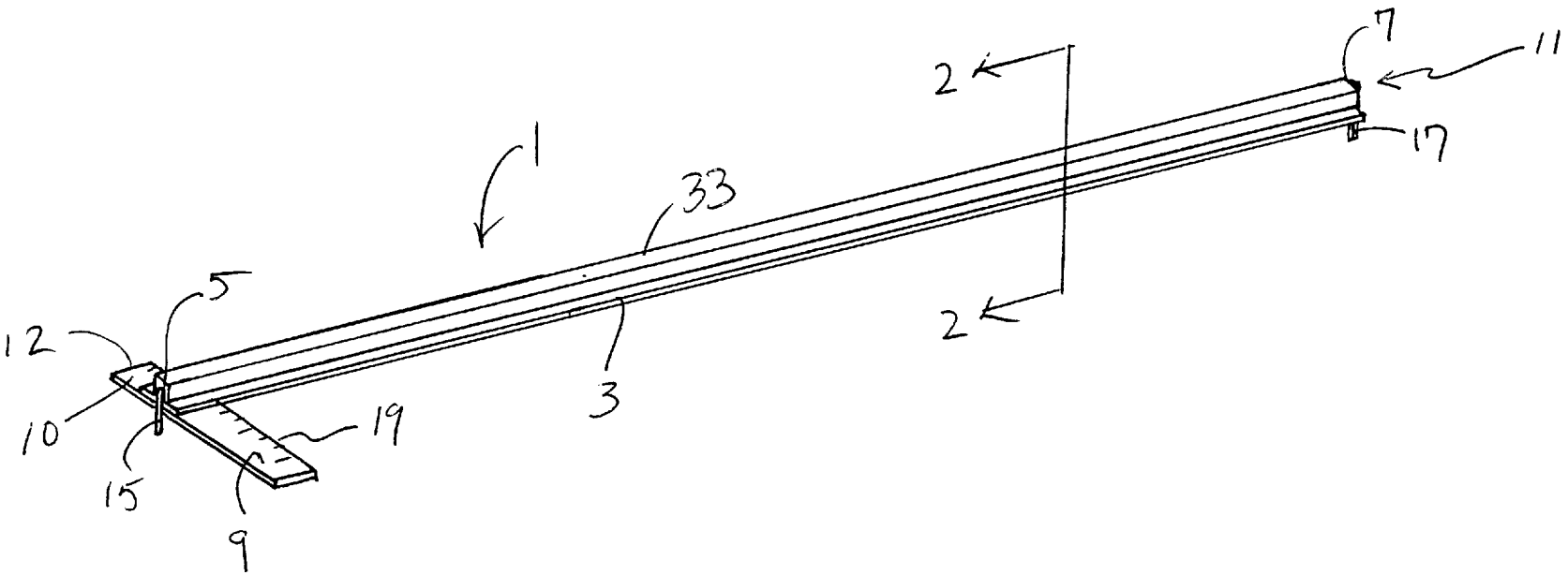
FIG. 1 is a perspective view of the saw guide showing the general elements of the T-square guide parts.

Referring to FIG. 1 a general description of the portable T-square saw guide 1 will now be provided. The saw guide 1 is composed of a guide arm 3 having a near end 5 and a far end 7, and an alignment arm 9 attached to the near end 5 of the guide arm 3. The guide and alignment arms 3, 9 may be fixedly joined or manufactured as one piece or may be joined by an adjustable joint which allows relevant movement between the two arms. In general, the alignment arm 9 is attached to the near end 5 of the guide arm 3 in a substantially perpendicular fashion so as to form a fixed 90 degree angle between the guide arm 3 and alignment arm 9. Such an alignment will be appreciated by those in the art as an L-square or a T-square which ensures that the guide arm 3 and any line to be scribed, drawn or cut relative thereto is aligned at the proper 90 degree angle with respect to a perpendicular edge of the work piece.

Attached to the guide arm 3 is a clamping mechanism 11 which extends from about the near end 5 along the longitudinal length of the guide arm 3 to the far end 7. The clamping mechanism 11 has a manual locking lever or knob 15 located adjacent the near end 5 and a clamp 17 adjacent the far end 7. A clamping rod 18 for securing the T-square guide arm 3 to a work piece is connected between the locking lever 15 and the clamp 17. The clamping mechanism 11 has a first untightened position where the locking lever 15, clamping rod 18 and clamp 17 are loose to allow the T-square guide arm 3 to be fit across a work piece, and a second clamped or tightened position where the locking lever 15 facilitates the tightening of the clamp 17 against an edge of the work piece.

In order to fully understand the novel aspects of the present invention, a short description of a conventional electric saw (not shown) is now provided. The conventional electric circular saw includes a hand grip with an activating trigger adjacent the hand grip so as to be either activated or deactivated by the user. The saw is also generally provided with a planar saw supporting platform through which the saw blade passes via a slot in the support platform. A springably rotatable safety cover is often used to cover the exposed part of the blade below the planar surface. The planar supporting platform has an outer edge which is often used by a worker to guide the saw along an edge or jig to produce a straight cut across a workpiece. The outer edge of the platform used for guiding the saw is known as a saw fence.

The problem to be solved by the present invention is to provide a continuous guiding edge which will continuously abut the saw fence during a cutting operation in order that such guiding abutment is constant despite any irregularities in the surface configuration upon which the supporting platform of the saw is resting or sliding as the saw is drawn across the workpiece.

Figure 2:
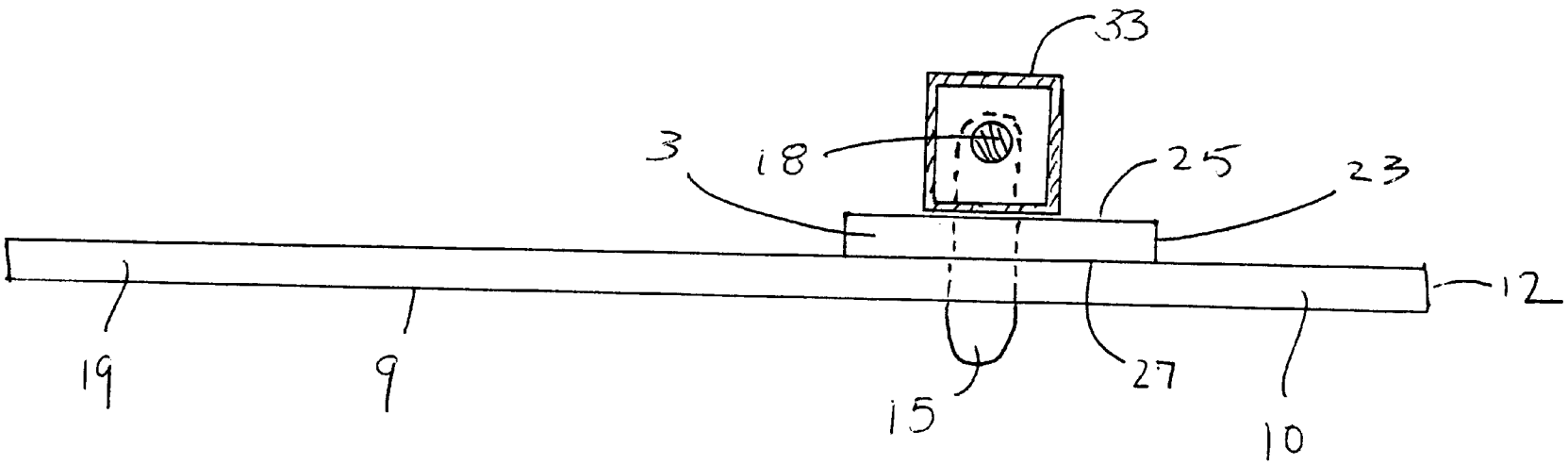
FIG. 2 is a cut away end view of the saw guide.

Turning now to FIG. 2 a further description of the saw guide 1 is now provided. The guide arm 3 of the saw guide 1 is provided with a guide edge 23, a top surface 25 and a bottom surface 27. The guide edge 23 functions as the actual contacting guide against which the saw fence of the circular saw follows as the saw is drawn across the work piece. Functionally, a worker, after securing the saw guide to the workpiece, rests the support plane of the saw on the edge of the work piece adjacent the near end 5 of the guide arm 3, with the saw fence contacting the guide edge 23 of the guide arm 3. The saw fence is kept in contact with the guide edge 23 by the worker as the saw is drawn across the work piece. With the saw guide 1 clamped to a work piece the operator has both hands free to further ensure the accuracy and guide the electric circular saw along the guide edge 23 of the guide arm and therefore produce a substantially and accurately cut straight line along the work piece.

The alignment arm 9 is provided with an inner alignment edge 19 for aligning the T-square saw guide 1, specifically the guide arm 3, at a desired angle, usually 90 degrees, relative to an edge of the work piece along which the inner alignment edge 19 of the arm 9 is positioned. The arm 9 may extend on either side of the near end 5 of the guide arm as in a T-formation, in order to provide proper setup of the saw guide 1 on the surface of the work piece and guidance of the saw with respect to the line to be cut. As an example, as previously described, the distance from the saw blade to the edge of the planar support defining the saw fence is known in the industry generally to have a range of about 0.5–3 inches, but in general is about 1.5 inches. Therefore, in an embodiment of the present invention, the alignment arm 9 will have an alignment end 10 extending perpendicularly directly out from the guide edge 23 of the guide arm 3 approximately 1.5 inches to the alignment cut edge 12. As is to be appreciated, a worker need merely line up the cut edge 12 with a desired marking on an edge of the work piece made where a worker desires to begin a cut. The saw fence then contacts the saw guide edge 23, which is set back from the alignment cut edge 12, and thus the desired cut line 1.5 inches, so that the blade of the saw will parallel the guide edge 23 cutting exactly along the desired cut line. Opposite from the cut 12, the alignment arm 9 may extend outwardly from the guide arm 3 to the opposing side any distance as desired. As the general setup and alignment of a T- or L-square is known in the art no further discussion is provided.

The guide arm 3 is usually, but not required to be, substantially longer than alignment arm 9, as in a traditional T or L-shaped builders square. The guide arm 3 can however be of any desired length, or even adjustable to fit a variety of lumber sizes. In one embodiment of the invention the near end 5 and the far end 7 are spaced at a distance commensurate with a traditional piece of rough cut lumber, for instance with a piece of 4'×8' size sheet of plywood of any thickness, the length of the guide arm 3 can be in general either four or eight feet depending upon the desired cut line.

The guide arm 3 is generally formed having a rectangular cross section, the top surface 25 and the bottom surface 27 of the guide arm 3 forming the longer sides of the rectangular cross section to provide rigid lateral stability to the guide arm 3, and the guide edge 23 and its opposing edge 24 forming the shorter sides of the rectangle to afford transverse flexibility to the guide arm 3 due to the relatively narrow thickness defined by the edges 23 and 24 of the rectangular cross section. It is to be appreciated that this relative transverse flexibility enables the guide arm 3 to flex and accurately engage a bowed or sagging surface of a work piece while remaining laterally rigid in order to provide the proper stiffened lateral support guidance for the saw fence of the circular saw.

Figure 3:
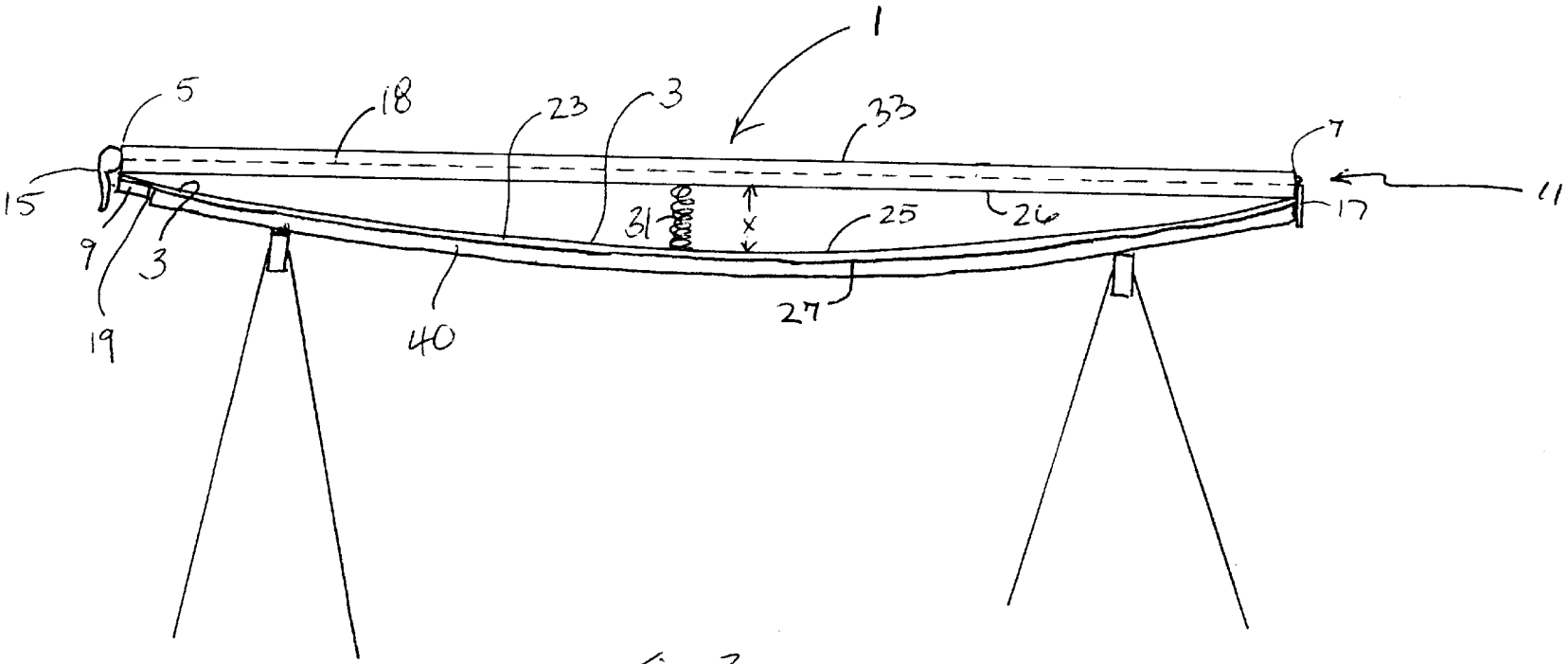
FIG. 3 is an elevation view of the saw guide in use with a workpiece.

Turning to FIG. 3, the clamping mechanism 11 has a housing 33 extending along the top surface of the guide arm 3 from the near end 5 to the far end 7. The housing 33 is substantially rigid and attached to the guide arm 3 at the near and far end 5, 7 by rivets or welding or other attachment methods as known in the art. It is to be appreciated that the middle portion of the housing 33 is not directly attached to the guide arm 3 and the transverse flexibility of the guide arm 3 allows the middle portion of the guide arm 3 to separate a distance x from the housing 33. The distance or spacing x being in the range of 0 to 4 inches, and more preferably in the range of 0 to 1 inches.

The housing 33 supports at either end the locking lever or knob 15 and the clamp 17 as well as the clamping rod 18 attached to and extending between the lever 15 and clamp 17. The housing 33 encases the clamping rod 18 and is substantially rigid in all directions to provide the appropriate clamping forces to secure the saw guide 1 to the work piece 40.

The locking lever or knob 15 works in conjunction with the housing 33 adjacent the near end 5 of the guide arm 3 so that a worker can easily operate the lever or knob 15 from the near end 5 of the guide arm 3 and housing 33. The locking lever or knob 15 may be a threaded bolt type tightening knob mechanism which engages threads on the rod through an aperture in the housing 33, to either tighten or loosening the rod 18 and the associated clamp 17 at the far end 5. The lever 15 may also be hingedly connected with the rod 18 and have a cam type surface associated with the housing 33 to tighten or loosen the rod 18 with respect to the housing dependent upon the relationship of the cam surface to the housing 33. As such mechanisms are well known in the industry no further discussion is provided.

The clamp 17 is tightened and loosened by the lever 15 via a connection joint with the rod 18. The clamp 17 is positioned adjacent the far end of the guide arm 3 and is cooperatively hinged to the housing 33, so that by respectively operating the locking lever or knob 15, the clamp 17 is either tightened or loosened with respect to the housing 33 and the work piece is securely sandwiched between the clamp 17 and the alignment edge 19.

Observing FIG. 3, it is to be appreciated that because the guide arm 3 and the housing 33 are affixed at substantially aligned near and far ends 5, 7, the transverse flexibility of the guide arm 3 allows the middle portion of the guide arm 3 between the near and far end 5, 7 to flex relative to the clamping mechanism housing 33 creating the variable space X between the top surface 25 of the guide arm and a bottom surface 26 of the housing 33.

A biasing element 31 such as a spring or elastomeric material or adjustable screw type mechanism as known in the art can be located between the top surface 25 of the guide arm 3 and the housing 33 to accentuate the space x between the substantially rigid housing 33 and the guide arm 3 and provide a substantially transverse biasing force to the flexing guide arm 3 in order to ensure the bottom surface 27 of the guide arm 3 is biased against and in intimate contact with the surface of the work piece 40. With the guide arm 3 and thus the guide edge 23 following any non-planer irregularity in the surface of the work piece 40, the saw fence of the electric circular saw cannot slip between the guide arm 3 and the work piece thus ensuring a completely guided and accurate cut across the work piece.

The saw guide 1 is designed to be portable and used with rough cut lumber or construction grade lumber. The lumber can be any type of construction grade lumber but specifically, an embodiment of the present invention will be useful for cutting generally sheets of plywood, particle board, cardboard, paper, plastic, metals and glass. It is standard in these varied industries to supply these materials in sheets in a general square or rectangular shape. The saw guide 1 is also designed to be light weight and easily and securely clamp down to the material or work piece so a worker is able to have both hands free to run the saw.

Figure 4:
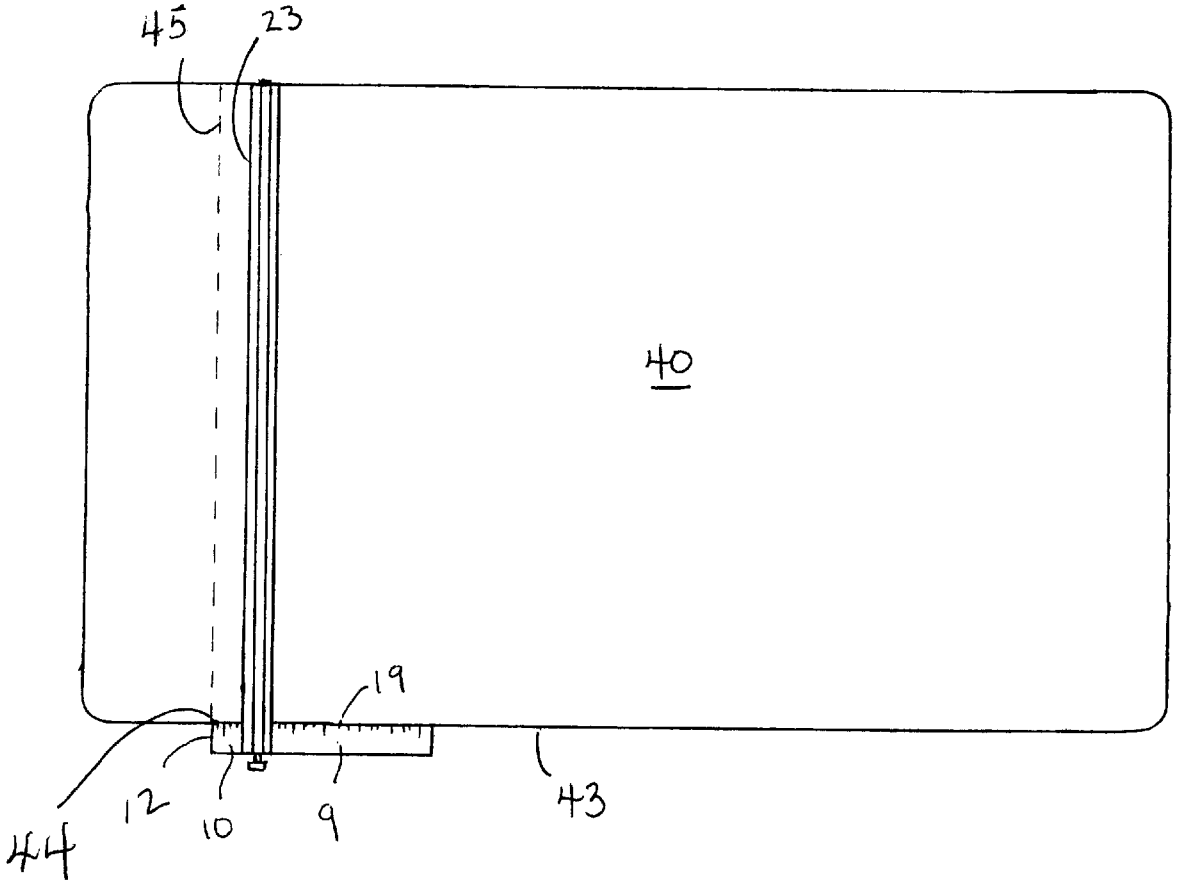
FIG. 4 is a planar view of the saw guide in use with a workpiece.

Functionally, an embodiment will now be described by way of example and by referring to FIG. 4. To cut a 4'×8' size sheet of plywood 40 to a desired size at a construction job site a worker typically places the plywood 40 on a support such as a lumber pile or saw horses. Next a cut mark 44 is measured and marked along an edge 43 or edges of the plywood work piece 40 to provide a cut line 45 to form the desired length and size of the plywood. To make a cut at a right angle from the edge 43, the alignment edge 19 of the alignment arm 9 is placed along the plywood edge 43 so that it butts up flush against plywood edge 43.

The cut edge 12 of the alignment end 10 is positioned adjacent the desired cut mark 44 so that the guide edge 23 is spaced parallel from the cut line 45 at the same distance as the saw fence is spaced from the cutting blade of the saw. The worker then operates the lever or knob 15 to tighten the clamp 17 against the opposing side of the work piece 40 and secure the saw guide 1 to the work piece 40. The worker then ensures that the bottom surface 27 of the guide arm is biased into engagement by the biasing element 31 with the surface of the work piece 40. As can be readily ascertained by a person of ordinary skill in the art, the saw next having been brought into contact with the plywood 40 with the blade aligned along the cut line 45, and the saw fence in contact with the guide edge 23 following any planar irregularities in the surface of the work piece 40, the worker may now confidently rely upon the guide edge 23 to continuously guide the saw despite any bend, flex or sag in the plywood 40.

As this invention may be embodied in several forms without departing from the spirit or essential characteristics thereof, the present embodiments are therefore illustrative and not restrictive, since the scope of the invention is defined by the appended claims rather than by the description, and all changes that fall within the metes and bounds of the claims or that form their functional as well as conjointly cooperative equivalents, are therefore intended to be embraced by those claims.

What is claimed is:

1. A portable saw guide comprising:

a guide arm having a near end and a far end;

an alignment arm attached to the near end of the guide arm, the guide arm and alignment arm defining a first plane;

a clamping mechanism extending along the guide arm and being fixedly attached tip the near and far ends of the guide arm; and wherein between the near and far ends the guide arm has a central guide edge freely flexible along a second plane substantially perpendicular to the first plane.

2. The portable saw guide according to claim 1, wherein the alignment arm is attached to the near end of the guide arm to form a right angle between the guide arm and the alignment arm.

3. The portable saw guide according to claim 1, wherein the alignment arm is attached to the near end of the guide arm by a rotatable joint to provide a variable angle between the guide arm and the alignment arm.

4. The portable saw guide according to claim 1, wherein the clamping mechanism further comprises a housing supporting an adjustment lever adjacent the near end of the guide arm, and a clamp adjacent the far end of the guide arm, the adjustment lever and clamp being connected by a clamping rod extending through a passageway in the housing.

5. The portable saw guide according to claim 4, wherein the housing is a rigid member connected to the guide arm at the near and far ends thereof and a spacing mechanism is provided intermediate the near and far ends and between the housing and the guide arm to provide a variable spacing therebetween.

6. The portable saw guide according to claim 4, wherein the clamping device has at least one lever means connected to the clamping rod so as to apply an axial force along the rod to tighten the clamp at the far end of the guide arm.

7. A portable saw guide comprising, a guide arm having a near end and a far end;

an alignment arm attached to the near end of the guide arm, the guide arm and alignment arm defining a first plane:

a clamping mechanism extending adjacent the guide arm and being separately attached to the near and far ends of the guide arm;

the guide arm has a guide edge flexible along a second plane substantially perpendicular to the first plane;

the clamping mechanism further comprises a housing supporting an adjustment lever adjacent the near end of the guide arm, and a clamp adjacent the far end of the guide arm, the adjustment lever and clamp being connected by a clamping rod extending through a passageway in the housing; and wherein the housing is a rigid member connected to the guide arm at the near and fat ends thereof and a spacing mechanism is provided intermediate the near and far ends and between the housing and the guide arm to provide a variable spacing therebetween.

8. The portable saw guide according to claim 7, wherein the alignment arm is attached to the near end of the guide arm to form a right angle between the guide arm and the alignment arm.

9. The portable saw guide according to claim 7, wherein the alignment arm is attached to the near end of the guide arm by a rotatable joint to provide a variable angle between the guide arm and the alignment arm.

10. A portable saw guide comprising:

an elongate base arm having a first and second end defining an x axis;

an elongate guide arm having a first and second end defining a y-axis, the base arm and guide arms being connected at a joint defining a z axis, with the respective x and y axis defining an x-y plane and the z and y axis defining a y-z plane perpendicular to the x-y plane;

an elongate clamping device having a first and second end connected with the first and second end of the guide arm respectively;

the guide arm is rigid in the x-y plane and flexible along the y-z plane perpendicular to the x-y plane; and wherein the guide arm has a middle portion which can be variably spaced along the y-z plane from the elongate clamping device.

11. The portable saw guide according to claim 10, wherein the clamping device is substantially rigid in both the x-y and y-z plane and comprises a spacer means to bias the middle portion of the guide arm away from the clamping device and along the y-z plane.

* * * * *